US006705598B2

(12) United States Patent
Collins

(10) Patent No.: US 6,705,598 B2
(45) Date of Patent: Mar. 16, 2004

(54) FENCE POST CONNECTOR

(76) Inventor: Charles R. Collins, P.O. Box 582, La Verkin, UT (US) 84745

( * ) Notice: Subject to any disclaimer, the term of this patent is extended or adjusted under 35 U.S.C. 154(b) by 0 days.

(21) Appl. No.: 10/268,366

(22) Filed: Oct. 10, 2002

(65) Prior Publication Data

US 2003/0066995 A1 Apr. 10, 2003

Related U.S. Application Data

(60) Provisional application No. 60/328,047, filed on Oct. 10, 2001.

(51) Int. Cl.[7] ..... E04H 17/02

(52) U.S. Cl. ..... 256/35; 256/36; 256/47; 256/65.03; 256/65.04; 256/65.05

(58) Field of Search ..... 256/30, 31, 35, 256/36, 47, 59, 63, 64, 65.01, 65.02, 65.03, 65.04, 65.05

(56) References Cited

U.S. PATENT DOCUMENTS

| | | | | |
|---|---|---|---|---|
| 413,730 | A | 10/1889 | Palmer | |
| 560,364 | A | * 5/1896 | Owens | 256/35 |
| 871,698 | A | * 11/1907 | Hohulin et al. | 52/152 |
| 1,543,392 | A | 6/1925 | Knopke | |
| 3,062,573 | A | 11/1962 | Roecker | |
| 4,889,322 | A | * 12/1989 | Wagner | 256/36 |
| 4,936,550 | A | 6/1990 | Wickham et al. | |
| 4,979,724 | A | 12/1990 | Williams | |
| 5,042,780 | A | * 8/1991 | Yearwood | 256/36 |
| 5,046,705 | A | 9/1991 | Williams | |
| 5,192,055 | A | 3/1993 | Griggs et al. | |
| 5,356,101 | A | 10/1994 | Malloy | |
| 5,439,201 | A | 8/1995 | Landreville | |
| 5,460,344 | A | 10/1995 | Malloy | |
| 5,518,333 | A | * 5/1996 | Cienkus, Jr. et al. | 403/169 |
| 5,593,143 | A | * 1/1997 | Ferrarin | 256/68 |
| 5,630,292 | A | 5/1997 | Heinz et al. | |
| 5,653,546 | A | 8/1997 | Cronkhite et al. | |

FOREIGN PATENT DOCUMENTS

| | | |
|---|---|---|
| GB | 536677 | 5/1941 |

* cited by examiner

*Primary Examiner*—Lynne H. Browne
*Assistant Examiner*—Michael P. Ferguson
(74) *Attorney, Agent, or Firm*—Mallinckrodt & Mallinckrodt; Robert R. Mallinckrodt

(57) ABSTRACT

A fence post connector includes a securement section for securing the post connector to a fence post and at least one receiving section for receiving an item to be joined. The item to be joined may be the end of a stabilizing fence post, a gate hinge, etc. For attachment to a T-post, a closure member captures the T-post between a pair of spaced arms extending from the receiving section and travel of the post connector along the T-post is limited by adjacent lugs extending from the T-post. These lugs may cooperate with the closure member, an arm, or the portion of the connector spacing the arms, to limit sliding. For attachment to a wood post, at least one arm abuts the post with an opening through which a fastener, such as a nail or screw, extends into the post. The post connector is generally used to connect fence posts in reinforcing configuration and loosely connects the various fence posts. The loose connection allows easy assembly of the various posts and tightening of one or more wires between posts tightens the posts and post connectors into a substantially rigid section of fence.

21 Claims, 9 Drawing Sheets

FENCE POST CONNECTOR

RELATED APPLICATION

Figure 3:
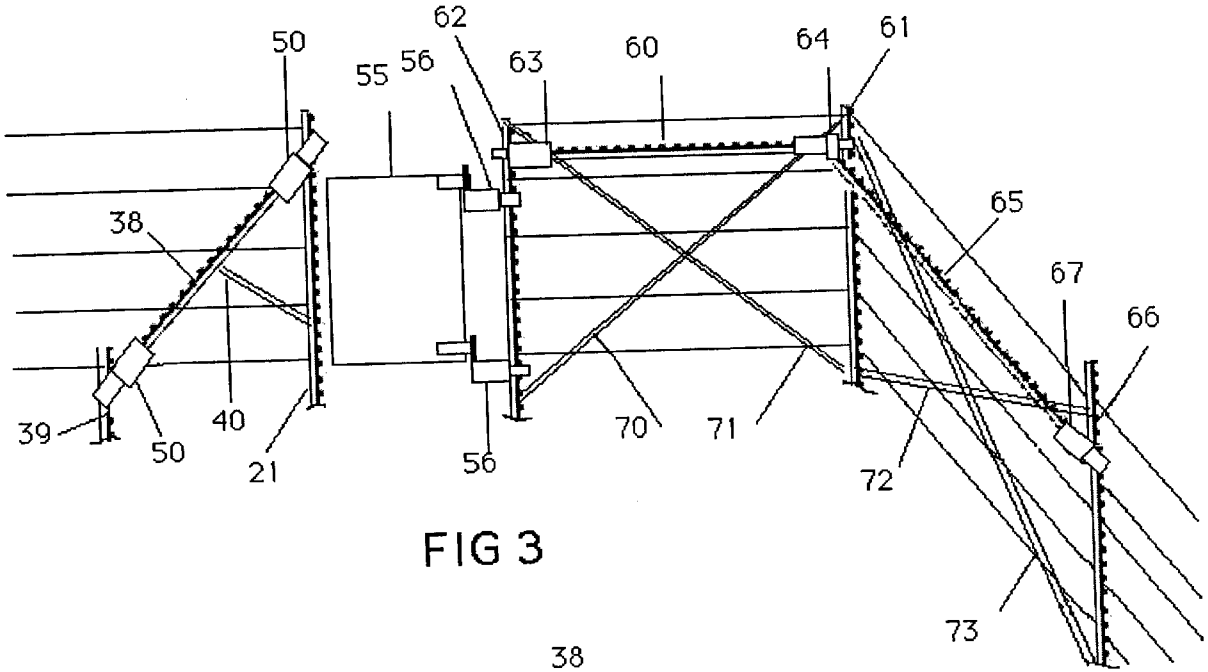

This application claims the benefit of Provisional Application Ser. No. 60/328,047, filed Oct. 10, 2001, and entitled "T Post Fence Connector."

BACKGROUND OF THE INVENTION

1. Field

The invention is in the field of fences and fence construction, particularly in construction of stabilizing sections of fence and in construction of such stabilizing sections of fence using T posts, and in connecting items, such as gates, to fence posts.

2. State of the Art

Many types of fences are used for various purposes. Barbed wire or other wire fences are extensively used to enclose areas to keep livestock or other animals in the area or outside of the area. Barbed or other wire fences are generally constructed using a plurality of fence posts spaced along the length of the fence so the barbed or other wire used is strung from post to post by attaching the wire to each post. The posts support the wire above the ground and hold it relatively taut. The fence posts are usually dug or driven into the ground so as to remain upright to support the wire. Such posts can usually adequately support intermediate sections of fence by merely being dug or driven into the ground because such posts merely have to space the wires and hold them above the ground and from being pushed laterally by the livestock or other animals. However posts used at corner sections of the fence or in reinforcing sections of the fence where high forces are applied to the posts because the wire is tightened around such posts to be held taut between such posts require additional support for the posts. Also posts on which gates are hung usually require additional support. While such posts can be cemented into the ground to stabilize them, usually such posts are stabilized by bracing extending at angles to the posts between posts or between the posts and the ground. Such bracing may use additional fence posts or a combination of fence posts and wire.

Many fences today are constructed using steel T-Posts. These posts have a T shape with projections or lugs extending along one surface which are used to hold barbed or other wire at a preset height along the post when secured to the post. These posts are easily driven into the ground, but are difficult to brace since it is difficult to connect braces to these posts. A number of special bracing systems using special brace connectors or brackets have been proposed and are shown in, for example, U.S. Pat. Nos. 5,653,546, 5,518,333, 5,460,344, 5,356,101, 4,979,724, 4,936,550, and 4,889,322. Of these, U.S. Pat. Nos. 4,889,322 and 4,979,724 show a connector comprising a collar which fits around and slides along a T-post to a desired location along the T-post. When in desired position, the sleeve is secured by a wedge inserted into the sleeve, which holds the sleeve positioned between adjacent lugs extending from the T-post. A brace socket is then attached to the collar to receive and hold an additional bracing post which fits freely into a receiving portion of the brace socket. Thus, such connectors include three separate pieces. With a collar post connector such as shown in U.S. Pat. Nos. 4,889,322 and 4,979,724, the collar must be placed over an end of the T-post to which it is secured and slid along the post to desired position. This is often inconvenient, and if a collar is to be added to a post between collars or wires already secured to the post, is difficult and time consuming as the other collars or wires have to be disconnected and slid to new positions or slid off the end of the post to allow the new collar to be slid onto and along the post to desired position. It would be desirable to be able to secure the post connector at any desired position along the length of the post without having to slide it along the post to that position. Further, the wedges used to secure the collars are separate small special pieces which are needed for securement and not easily replaced if lost.

U.S. Pat. No. 5,518,333 similarly shows a sleeve which is placed over an end of a T-post and is slid to a desired position along the T-post. An internal keyway in the sleeve allows only one orientation of the sleeve on the post. When in position, a pin is inserted through the sleeve to fit between adjacent lugs to position the sleeve along the post. An additional post fits freely into a receiving portion of the connector. Again, having to place the sleeve over the end of the post and slide it along the post to desired position is often inconvenient and difficult and the single orientation of the sleeve on the post limits the flexibility of use and requires a larger assortment of post connector configurations than might be necessary with no limitation on orientation.

Room remains for improvement in such connectors to make them economical and easy and simple to use.

SUMMARY OF THE INVENTION

According to the invention, a fence post connector for joining or connecting fence posts in stabilizing sections of fence, or for connecting other items to a fence post, includes a securement section configured to be secured to a fence post at a desired location along the fence post to which the post connector is to be secured without having to slide the post connector along the post to that position. At least one receiving section of the post connector is configured to freely receive therein an end of a fence post, such as a stabilizing post, or another item, such as a gate hinge, to be received.

The securement section of the post connector may be configured to be secured to a T-post, in which case the securement section includes a pair of spaced arms each having a free end so that a T-post can be inserted and received between the spaced arms. A closure member, such as an easily obtainable bolt, pin, or wire, inserted through holes through the arms toward the free ends thereof, secures the post connector to the post. This securement is accomplished by the closure member capturing the T-post between the arms so that the closure member, an arm, or the portion of the connector spacing the arms fits between projections or lugs extending from the T-post to keep the post connector in position along the T-post. The securement of the post connector to the post generally is not a rigid or tight securement. The post connector can move somewhat with respect to the post as the bolt, arm, or spacing portion of the connector slides between and is stopped by one of the lugs.

Thus, with a T-post, the T-post is captured and held between the arms. The sizing of the closure member, arms, and portion of the connector spacing the arms, and their spacing and arrangement is such that with a T-post captured between the arms, the T-post can be positioned so that any one of the closure member, an arm, or the portion of the connector spacing the arms will fit between lugs or otherwise cooperate with lugs extending from the T-post to limit the sliding of the connector along the T-post. With the closure member, arms, and portion spacing the arms all sized to cooperate with the lugs, the connector can be secured to the T-post with various rotated orientations with respect to the T-post. This provides desired flexibility for the user in securing the connector to the T-post.

Alternately, the securement section may be configured to be secured to a wood fence post, in which case the securement section includes at least one arm having one or more openings therethrough with the at least one arm positioned to abut the fence post to which it is to be secured. A securement means, such as a nail or screw, extends through each of the one or more openings to secure the post connector to the fence post.

The receiving section of the post connector is configured to freely receive therein an end of a fence post or other item to be received. This section will usually include an opening into which the end of a fence post or other item, such as a T-post, is inserted and may be a receiving tube, such as a square tube, for the end of the fence post or other item to slide into. When T-posts are being connected, the end of the post received in the receiving section can abut the T-post to which the post connector is secured. When a T-post is being connected to a wood post, a divider between the receiving section and arms of the post connector preferably separates the end of the T-post from the wood post to prevent the metal T-post from rubbing against and wearing away the wood post, thereby loosening the connections. This divider may be easily formed by positioning an arm or divider along the end of the receiving section to divide it from the securement section.

The post connectors are usually used in constructing stabilizing sections of fence wherein stabilizing fence posts are oriented to extend horizontally or at an angle between vertically oriented fence posts. In some instances one of the vertically oriented fence posts may merely be a stabilizing post rather than a fence holding or mounting post. In use, the post connectors are loosely secured to vertically oriented fence posts between which the stabilizing posts extend and the horizontal or angled stabilizing fence posts are inserted into the receiving sections. The post connectors are then positioned as desired to hold the posts. This assembly of posts will generally initially be a loose assembly wherein the posts can move relative to one another. It is not necessary that the assembly of posts itself be tight to form the stabilizing section of fence. This makes assembling the posts together relatively easy. Once the posts are assembled and loosely connected, wire is secured and tightened between at least two of the connected posts to complete the stabilizing section by tightening the connected fence posts in the post connectors, and, when T-posts are used, tightening the connectors against T-post lugs. Thus, although when using T-posts the post connector is initially loosely secured to the post to which it is to be connected, the installation and tightening of the wire tightens all of the post connectors against the fence posts and fence post lugs. This tightening with wire draws the posts and connectors together into a tight stabilizing section of fence.

The design of the connector makes it easy and simple to use. With T-posts, a square receiving tube for the end of the T-post received along with the spacing of the arms and the closure member allow the connector to be drawn up nicely and taut between lugs of a T-post to which it is attached when the wire is tightened. Generally, the wire will be looped around the posts between which it extends and a stick or similar handle is inserted between the wires of the loop and turned to twist the wires together to tighten the wire in known manner.

THE DRAWINGS

Figure 1:
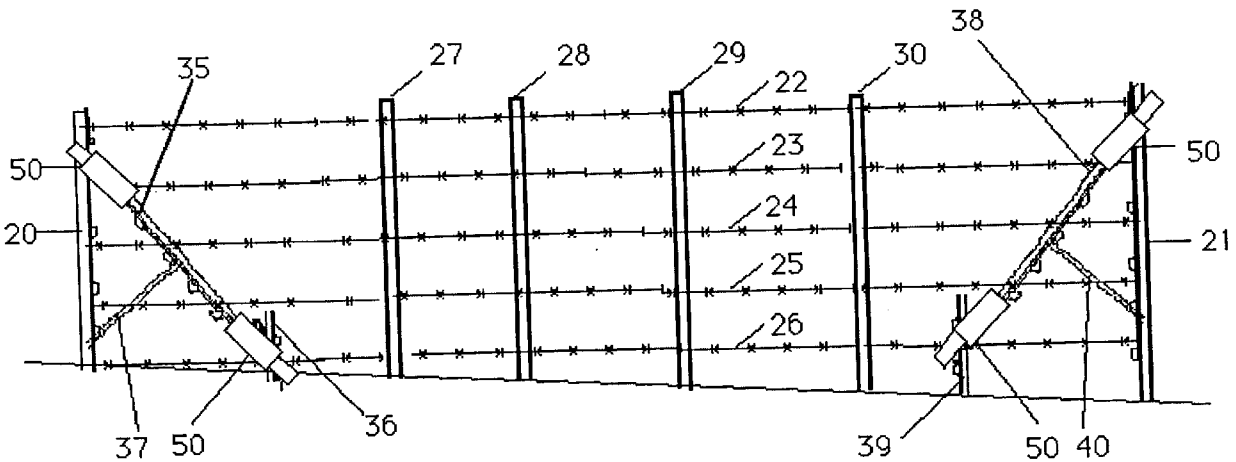
Figure 2:
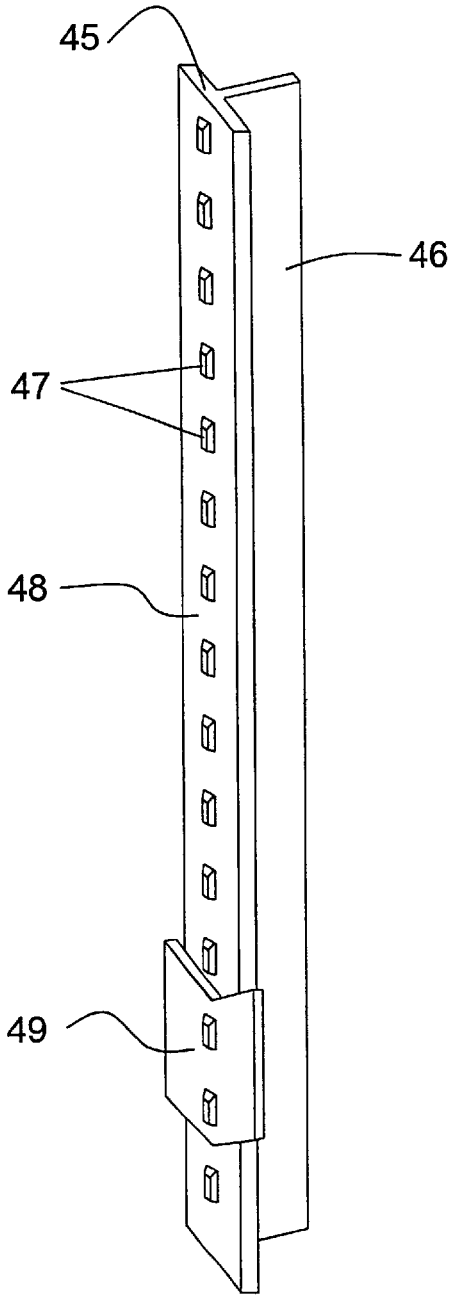
FIG. 2 PRIOR ART
Figure 4:
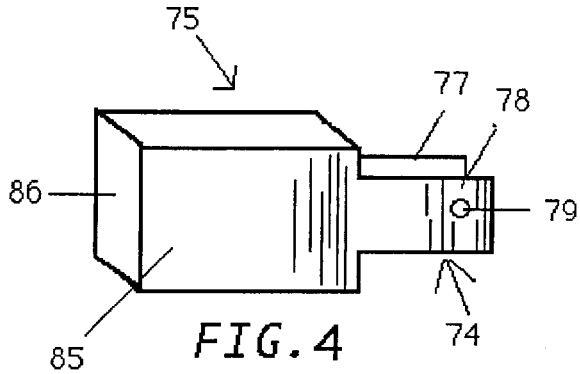
Figure 5:
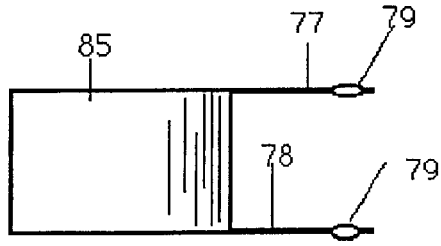
Figure 6A:
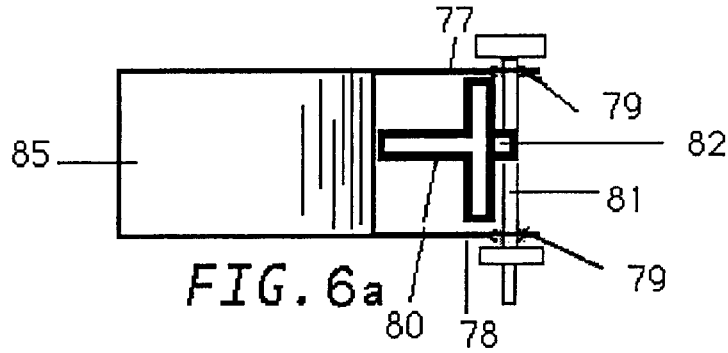
Figure 6B:
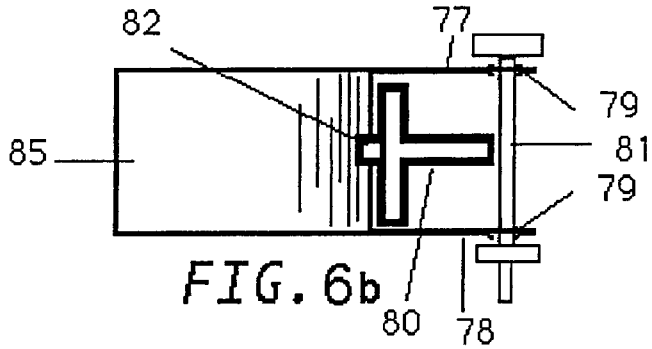
Figure 6C:
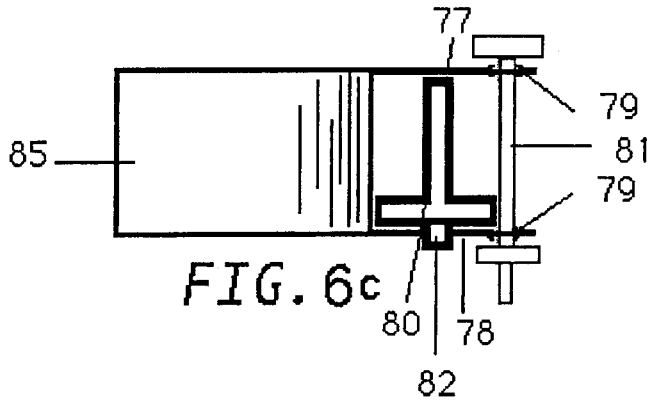
Figure 6D:
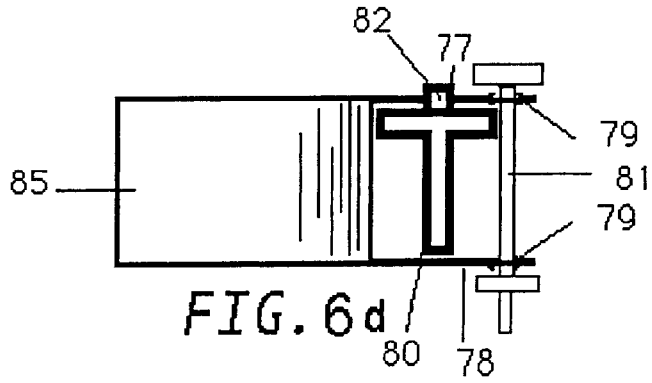
Figure 7A:
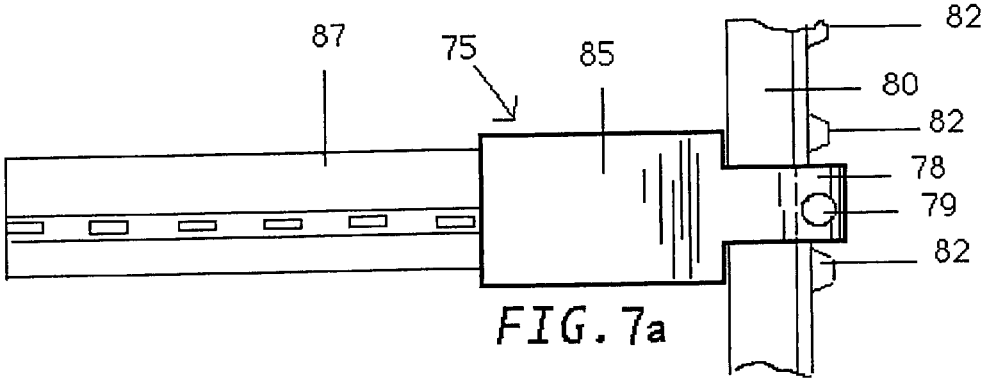
Figure 7B:
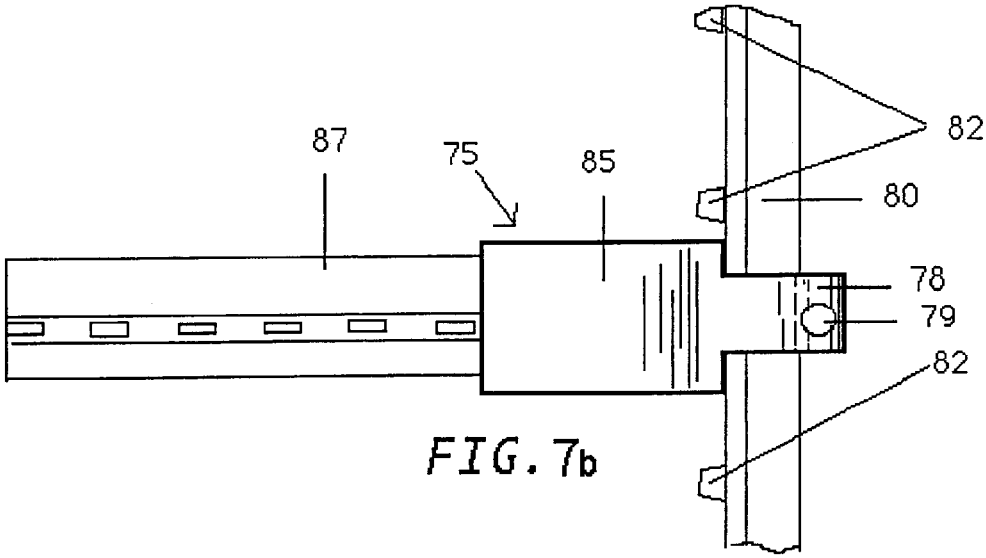
Figure 7C:
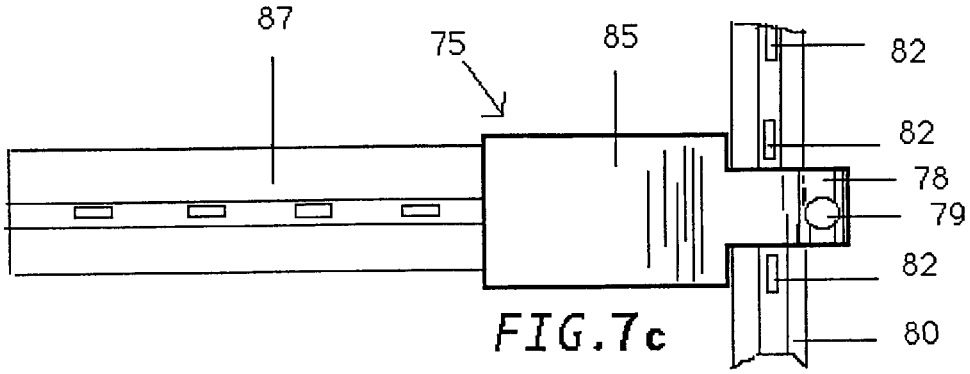
Figure 8:
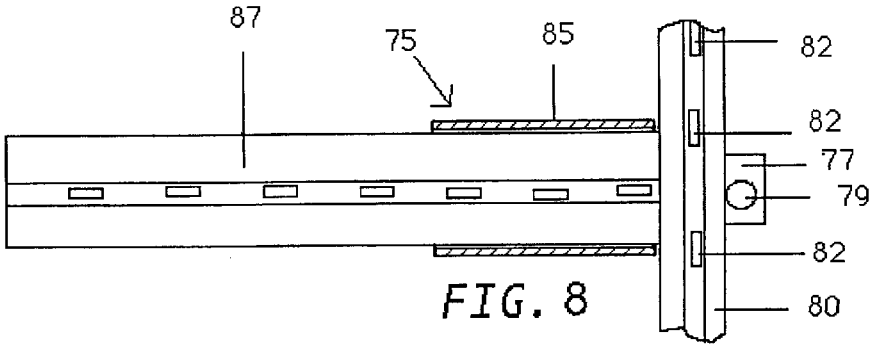
Figure 11:
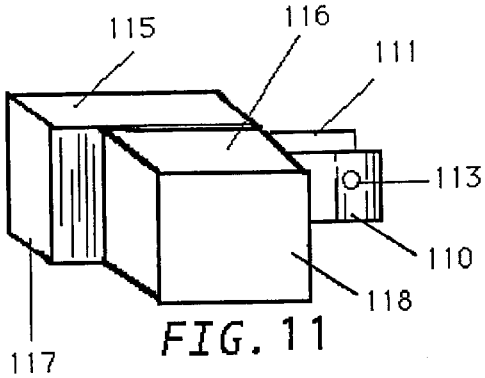
Figure 12:
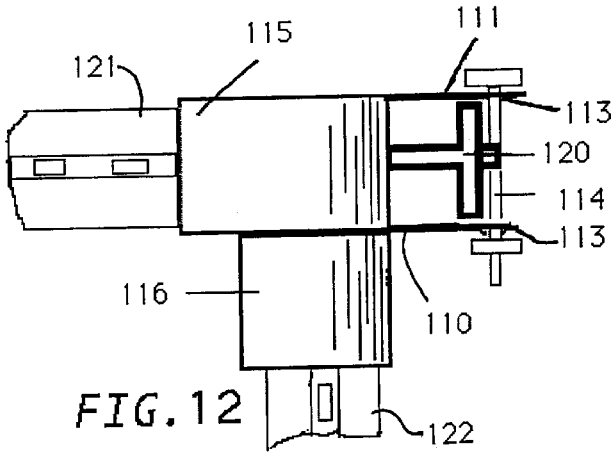
Figure 13:
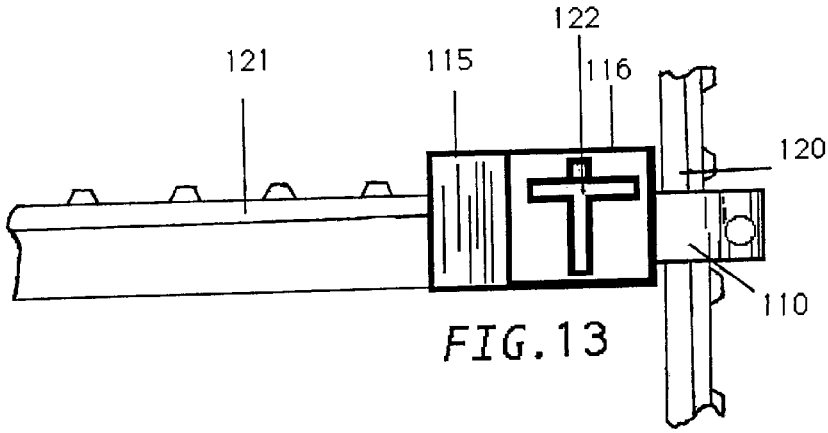
Figure 9:
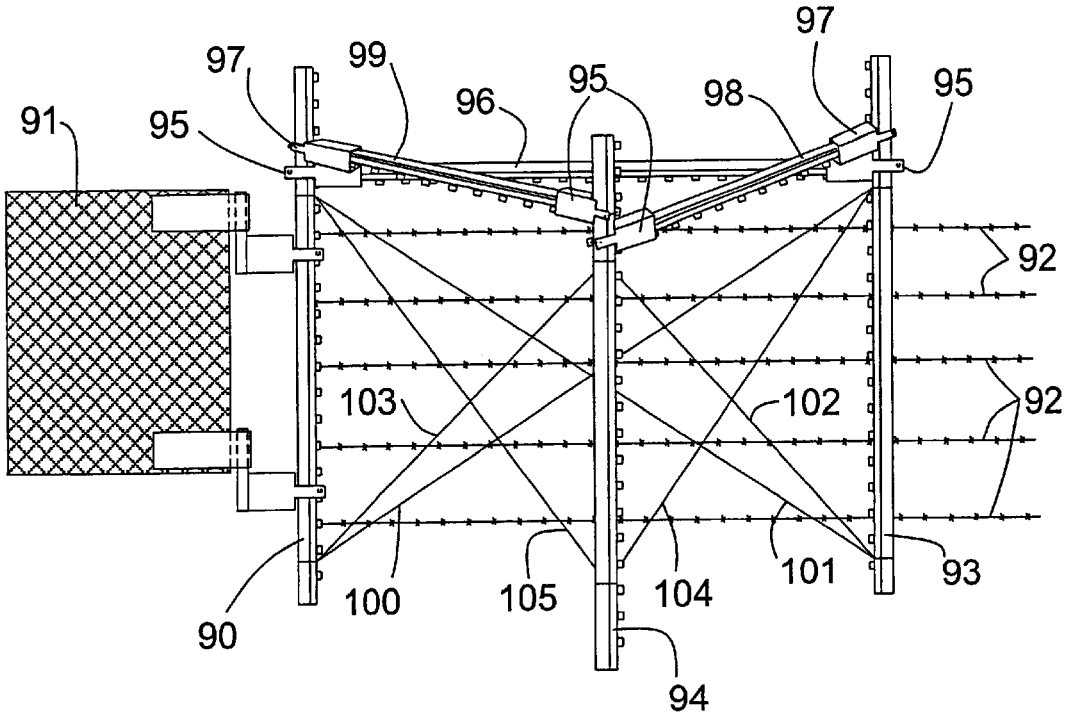
Figure 10:
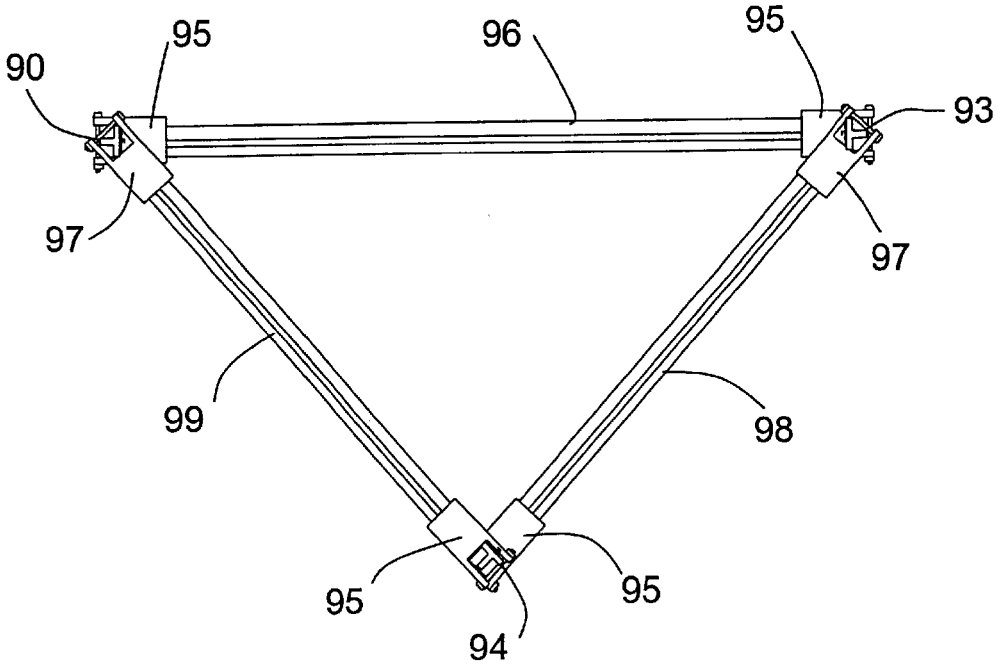
Figure 14:
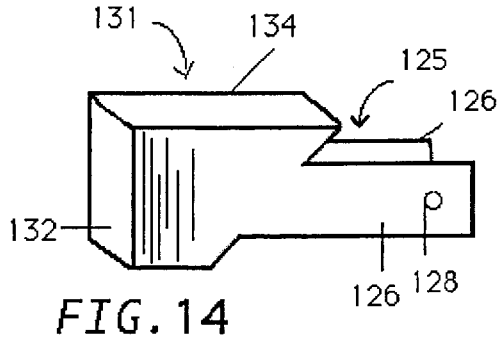
Figure 15:
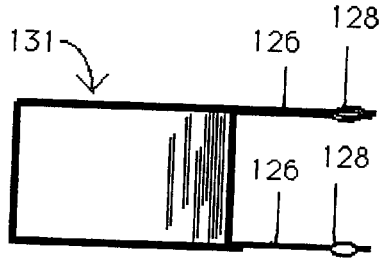

The best mode presently contemplated for carrying out the invention is illustrated in the accompanying drawings, in which:

FIG. 1 is a schematic showing of a substantially straight run of fence having end sections stabilized using connectors of the invention;

FIG. 2, a perspective view of a typical T-post;

FIG. 3, a schematic showing of a corner portion of a fence having end sections stabilized using connectors of the invention and having a gate hung using connectors of the invention;

FIG. 4, a perspective view of one embodiment of a connector of the invention;

FIG. 5, a top plan view of the connector of FIG. 4;

FIG. 6*a*, a top plan view similar to that of FIG. 5, but showing the connector installed on a T-post with a particular T-post orientation;

FIG. 6*b*, a top plan view similar to that of FIG. 6*a*, but showing a different T-post orientation;

FIG. 6*c*, a top plan view similar to that of FIG. 6*a*, but showing a different T-post orientation;

FIG. 6*d*, a top plan view similar to that of FIG. 6*a*, but showing a different T-post orientation;

FIG. 7*a*, a side elevation of the connector mounted on a T-post as shown in FIG. 6*a*, additionally showing a stabilizing post therein;

FIG. 7*b*, a side elevation of the connector mounted on a T-post as shown in FIG. 6*b*, additionally showing a stabilizing post therein;

FIG. 7*c*, a side elevation of the connector mounted on a T-post as shown in FIG. 6*c*, additionally showing a stabilizing post therein;

FIG. 8, a side elevation similar to that of FIG. 7, but with the connector shown in section so that the T-posts are visible;

FIG. 9, a schematic showing of an embodiment of a special stabilizing section of fence;

FIG. 10, a top plan view of the stabilizing section of fence shown in FIG. 9;

FIG. 11, a perspective view of a second embodiment of a connector of the invention;

FIG. 12, a top plan view of the connector of FIG. 11 showing it mounted on a T-post and showing stabilizing posts therein;

FIG. 13, a side elevation of the connector mounted on a T-post as shown in FIG. 12;

FIG. 14, a perspective view of a third embodiment of a connector of the invention;

FIG. 15, a top plan view of the connector of FIG. 14.

Figure 16:
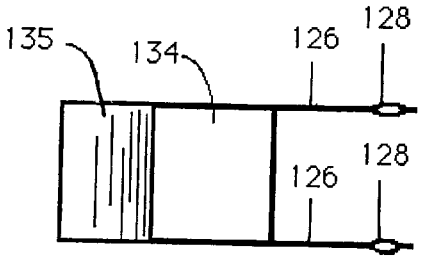

FIG. 16, a bottom plan view of the connector of FIG. 14.

Figure 17:
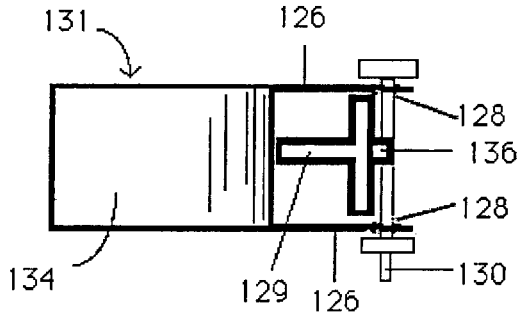
Figure 18A:
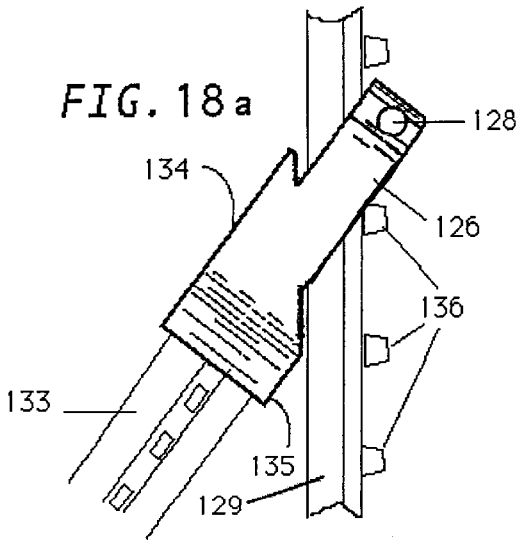
Figure 18B:
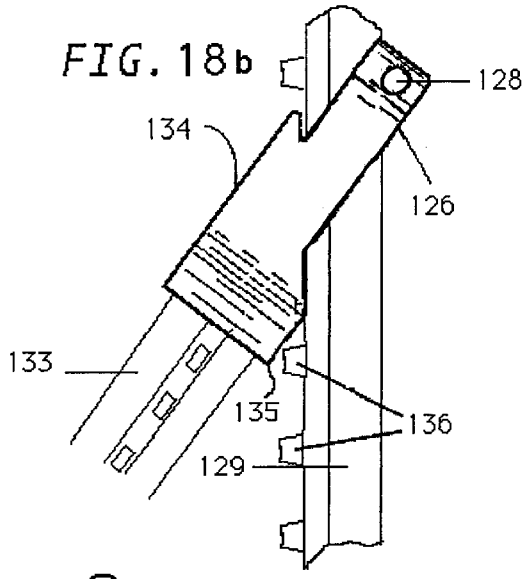
Figure 18C:
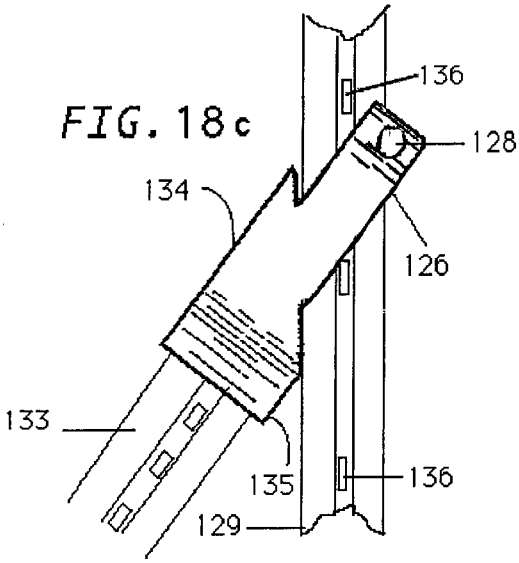
Figure 19:
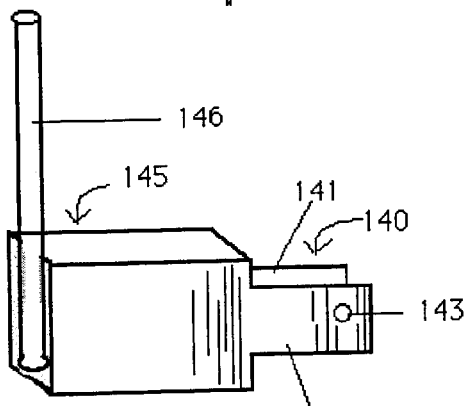
Figure 20:
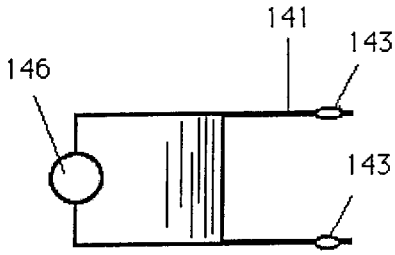

FIG. 17, a top plan view similar to that of FIG. 15, but showing the connector installed on a T-post;

FIG. 18*a*, a side elevation of the connector mounted on a T-post as shown in FIG. 17, additionally showing a stabilizing post therein;

FIG. 18*b*, a side elevation similar to that of FIG. 18*a*, but showing a different orientation of T-post;

FIG. 18*c*, a side elevation similar to that of FIG. 18*a*, but showing a different orientation of T-post;

FIG. 19, a perspective view of a fourth embodiment of a connector of the invention;

FIG. 20, a top plan view of the connector of FIG. 19.

Figure 21:
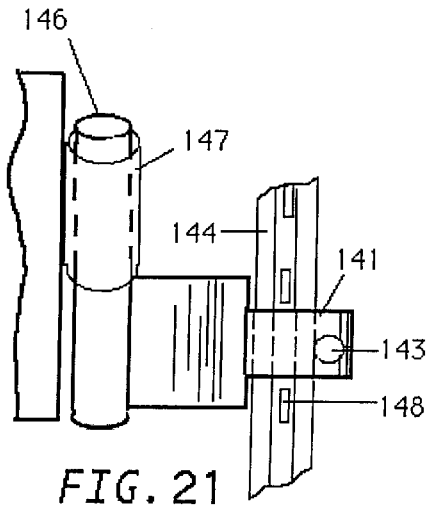
Figure 22:
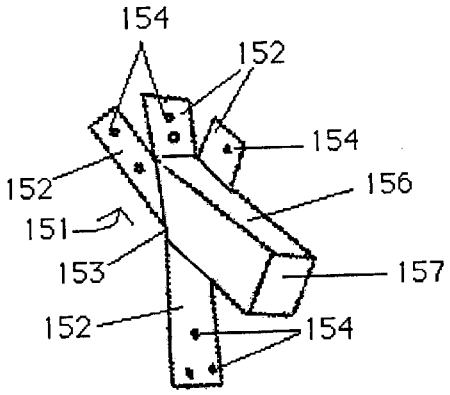
Figure 23:
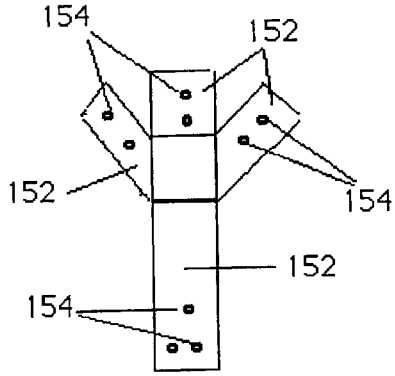
Figure 24:
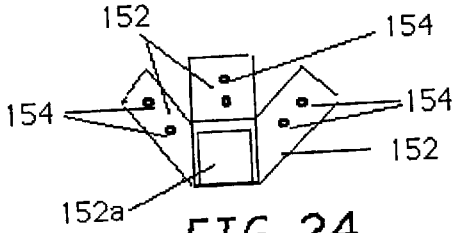
Figure 25:
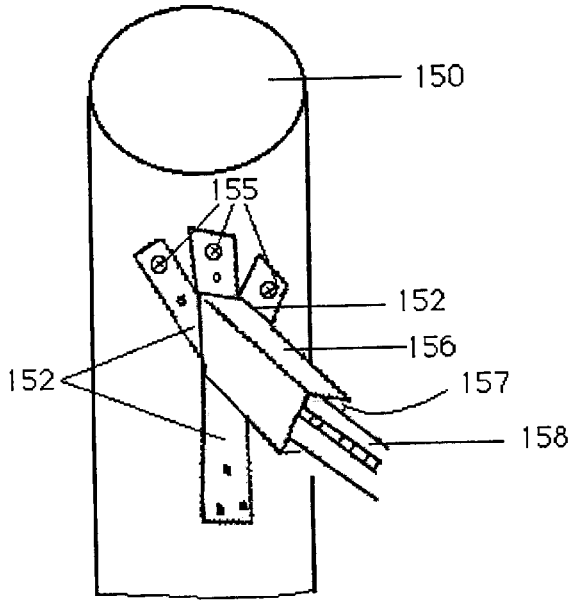

FIG. 21, a side elevation of the connector mounted on a T-post and showing a stabilizing post therein;

FIG. 22, a perspective view of a fifth embodiment of a connector of the invention;

FIG. 23, an rear elevation of the connector of FIG. 22;

FIG. 24, a similar rear elevation showing a further embodiment of the connector of FIG. 22; and FIG. 25, a perspective view of the connector of FIG. 22 secured to a wooden fence post with a stabilizing post therein.

DETAILED DESCRIPTION OF THE ILLUSTRATED EMBODIMENTS

FIG. 1 shows schematically a length of typical barbed wire fence. Opposite substantially vertical end posts 20 and 21 define the ends of a substantially straight run of fence with strands of barbed wire 22, 23, 24, 25, and 26 extending between the end posts and supported to maintain their spacing, prevent substantial sagging, and resist lateral movement of the wire, such as in response to livestock pushing against the wire, by intermediate posts 27, 28, 29, and 30. The number of intermediate posts will vary depending upon the length of the fence involved and distance between posts. Intermediate posts are generally spaced from about ten to seventeen feet apart depending upon the terrain and the use of the fence. It is generally important that the strands of barbed wire be stretched taut between the end posts. This, however, puts significant stress on the end posts 20 and 21 tending to pulling the end posts toward one another. If the end posts are not secured to resist this stress, the posts will be pulled toward one another and the wire will not be held in taut condition. The posts may be secured to resist this stress by securing the end posts in concrete in the ground, but usually the posts will be secured by bracing the end fence posts.

The end posts, or posts in an intermediate portion of the stretch of fence if a long stretch of more than about one-tenth to one-half mile is involved, may be braced as shown in FIG. 1, by extending a stabilizing fence post 35 at an angle to the vertical end post 20 between the vertical end post 20 and a stabilizing vertical post 36 spaced from the end post 20 a distance so that stabilizing post 35 can be secured between them. A wire 37 is tightened between stabilizing post 35 and end post 20 to complete the bracing and stabilize end post 20. Wire 37 is preferably looped over stabilizing post 35 and end post 20 so that a stick can be positioned between the wires about midway between stabilizing post 35 and end post 20 as a handle and turned to twist the wires together to tighten them. Opposite end post 21 is similarly stabilized by stabilizing post 38, stabilizing vertical post 39, and wire 40.

Various types of fence posts may be used. Sometimes wood posts will be used, but it is convenient and economical to use T-posts. T-posts are steel posts with a "T" cross section which are easily driven into the ground. A typical T-post is shown schematically in FIG. 2. The T-post has cross portion 45 and leg 46 to form the "T". Lugs 47 are spaced along and extend from cross portion face 48. A guide plate 49 is secured to the post at a position just below the expected ground level when the post is driven into the ground so that normally the guide plate will be in the ground to help hold the post. The cross portion 45 is shown schematically in the drawings as a flat section for ease of illustration, but in most cases for actual T-posts, the ends of the cross portion will have a small curve in the direction of the lugs. Stabilizing vertical posts 36 and 39 may be short T-posts driven into the ground at the appropriate distance from the post being stabilized. A normal length T-post may be cut, such as into thirds, for use as the short stabilizing vertical posts. The stabilizing posts 35 and 38 will normally be the same as the vertical posts used in construction of the fence. As shown in FIG. 1, the stabilizing posts are secured to the vertical posts using post connectors 50 of the invention.

FIG. 3 shows a further arrangement of fence. A gate 55 is included and is supported by special gate connectors 56 of the invention secured to vertical fence post 62. The length of fence to the left of the gate is similar to that shown in FIG. 1, with the same reference numbers used, and will not be described further. A fence corner is shown to the right of the gate with the two sections forming the corner being reinforcing sections. In these sections, the reinforcing post is arranged substantially horizontally between vertical fence posts rather than diagonally as in the reinforcing section to the left of the gate and the reinforcing sections of FIG. 1. Thus, stabilizing post 60 is connected horizontally between corner vertical post 61 and vertical post 62 with connectors 63 and 64 of the invention. Stabilizing post 65 is connected horizontally between corner vertical post 61 and vertical post 66 with connectors 64 and 67. The horizontal stabilizing posts are spaced above the ground near the upper ends of the vertical posts. Wires 70 and 71 are stretched and tightened between vertical posts 61 and 62 and wires 72 and 73 are stretched and tightened between vertical posts 61 and 66. These wires tighten and hold the reinforcing sections tightly together.

The connectors of the invention may take various configurations. Connectors 63 and 67, FIG. 3, connect a single, substantially horizontal stabilizing post to spaced vertical posts and makes the connection at a ninety degree angle to the vertical posts. Such connector is shown in detail in FIGS. 4–8. The connector includes a securement section 74 and a receiving section 75. The securement section 74 in this embodiment is configured to be secured to a T-post and includes two spaced apart arms 77 and 78 extending from opposite sides of a receiving tube, preferably a square receiving tube, forming the receiving section 75. In this case the end of the receiving section 75 from which the arms extend forms the portion of the connector spacing the arms. The arms may be formed by continuations of two opposite sides of the tube with opposite connecting sides of the tube between the arms removed or bent out of the way. Also, the connector may be open from the tube forming the receiving section 75 to the arms forming the securement section 74.

Each of the arms 77 and 78 include a free end with an opening 79 therein toward the free end. The arms are spaced to receive a T-post 80, FIG. 6, therebetween. After receiving the T-post 80 between arms 77 and 78, a closure member, such as a bolt 81, is passed through openings 79. Various other closure members may be used, such as various types of pins or a piece of wire that is inserted through the opening 79 with the ends of the wire extending around the free ends of the arms and twisted together. A nail could even be positioned through the openings 79 if that is all that is available and the end of the nail bent to keep the nail in place. The closure member could also be arranged to extend between the free ends of the arms secured to the arms in any suitable manner. For example, the closure member could be hinged to the free end of one arm with a securement catch at the end of the other arm to hold the member closed when a T-post is captured between the arms and releasable to open the closure member to capture or release the post. The purpose of the closure member is to capture the fence post to which the post connector is to be connected between the arms and any way of doing this will be equivalent to what has been shown and described.

Arms 77 and 78, along with openings 79, are all spaced so that when a normal T-post 80 is captured between the arms, the connector will be held between two adjacent lugs 82 extending from the T-post 80. Thus, if the T-post is positioned as shown in FIGS. 6*a* and 7*a*, a closure member extending through openings 79 will pass across the face of the cross portion of the T-post and will be located to fit between two adjacent lugs 82. The connector will be able to slide upwardly along the T-post until the closure member abuts the upper of the adjacent lugs or downwardly along the T-post until the closure member abuts the lower of the adjacent lugs. When the closure member abuts the lug, travel of the connector along the T-post in that direction is stopped. The end of the receiving section 75 where it joins the securement section 74, i.e., where the arms 77 and 78 extend from the usually tubular receiving section, will be sized so that opposite walls of the tube will fit between lugs. The connector is then held in position along the post by one of the walls abutting a lug as shown in FIGS. 6*b* and 7*b*. The arms 77 and 78 of the connector are each sized so that they too can fit between lugs of the T-post. With the connector positioned in relation to the T-post as shown in FIGS. 6*c* and 7*c*, arm 78 is positioned between adjacent lugs rather than the closure member. The connector can be similarly positioned so that arm 77 is positioned between lugs 82 as shown in FIG. 6*d*. The arms could also be configured with an opening to receive a lug therethrough so the connector is held in position along the post by the lug extending through the opening. The advantage of having the closure member, the arms, and the portion of the connector spacing the arms all sized and configured to fit between lugs is that the connector can be arranged so that the receiving section 75 extends from any desired side of the T-post 80.

Receiving section 75 provides walls 85 forming a square receiving opening and square receiving tube 86 to receive an end of stabilizing post 87 therein. Stabilizing post 87 freely slides into receiving opening 86. As shown in FIG. 8, the end of T-post 87 extends through receiving section 75 into securement section 74 to abut T-post 80. Rather than a square receiving tube, a cylindrical receiving tube could be used. Other shapes could also be used, but may limit the orientation of the post received therein. It is preferred that the receiving tube be able to receive the stabilizing post in any orientation.

The size of T-posts vary to some degree. The cross portion of a standard size T-post varies between about one and one-quarter inch to about one and three-eights inch and the leg of the T varies between about one inch and about one and one-quarter inch. The lugs usually extend between about one-eighth and one-quarter inch from the face of the cross portion. The receiving opening and tube of a standard size connector are sized to receive the largest standard size T-post therein. Also, the arms of a standard size connector of the invention are spaced to accept the largest standard size T-post between the arms. There are some larger size T-posts with cross portion about one and three-eighth inch and legs about one and three-eighth inch. For this larger size T-post, a larger size connector will generally be needed. While the arms of the securement section of the connector may closely receive the T-post therebetween, particularly a larger T-post, the spacing of the arms and the closure members need only be such that the connector is held by a lug, as explained, when the closure member, an arm, or the portion of the connector spacing the arms is aligned with the face of the cross portion of the T. In some instances, the T-post can be received at an angle between the arms. In such case, while the T-post is captured between the arms, the connector may not be oriented with respect to the T-post to prevent the connector from sliding along the post. In such instance, that angled connector may be positioned vertically above a regularly placed connector to be held up by that connector.

Such a situation may occur in constructing a special reinforcing section of fence as shown in FIGS. 9 and 10. This type of reinforcing section stabilizes the vertical posts against movement in all directions and is particularly advantageous for stabilizing posts for gates. As shown in FIG. 9, a fence end post 90 supports gate 91. Barbed wires 92 form the fence and are secured to fence end post 90 and are supported also by post 93. A vertical stabilizing post 94 is spaced laterally from the fence between posts 90 and 93. Connectors 95 as shown in FIGS. 4–8 are located on posts 90, 93, and 94 as shown to connect horizontal stabilizing post 96 between posts 90 and 93 and to connect one end of horizontal stabilizing post 98 to vertical post 94. Connectors 97, also as shown in FIGS. 4–8, are located on posts 90, 93, and 94, as shown, to connect horizontal stabilizing posts 98 and 99 between posts 93 and 94 and between posts 90 and 94, respectively. The only difference between connectors 95 and 97, as best seen in FIG. 10, are that connectors 95 are secured to the respective fence posts so as to engage lugs extending from the fence posts, as described above, to limit sliding of the connectors along the posts. Connectors 97 are secured to the respective fence posts at an angle where they do not engage the lugs so can slide along the fence posts. Note that connectors 97 are all located on the respective fence posts vertically above a connector 95 so that connectors 95 will limit sliding downwardly of connectors 97.

In making the connections between the posts, connectors for one end of the horizontal posts can be attached to a vertical post, the horizontal posts inserted into the receiving sections and connectors placed on the ends of such posts which are then moved to position and connected to the other vertical post concerned. These connections are loose connections since the connectors, as described, can slide to some extent along the vertical posts and the ends of the horizontal posts can slide in the receiving portions as they are freely received in such portions. To tighten the stabilizing section and actually stabilize all posts, wires are stretched between various posts and tightened. The particular posts between which the wires are connected is not critical as long as tension can be applied to the posts to tighten all connections so all posts are held tightly and securely in the connectors and all connectors are held tightly to the posts to which they are secured. In the embodiment shown, wire 100 extends diagonally between the upper portion of post 93 and the lower portion of post 90, wire 101 extends diagonally between the upper portion of post 90 and the lower portion of post 93, wire 102 extends diagonally between the upper portion of post 94 and the lower portion of post 93, wire 103 extends diagonally between the upper portion of post 94 and the lower portion of post 90, wire 104 extends diagonally between the upper portion of post 93 and the lower portion of post 94, and wire 105 extends diagonally between the upper portion of post 90 and the lower portion of post 94. These wires are all tightened which tightens all connections between posts and forms a tight stabilizing section of fence. With this stabilized section of fence, the posts 90, 93, and 94 are all stabilized against movement in all directions. With the stabilizing sections shown in FIGS. 1 and 3, the posts involved in each section are stabilized only in the direction of pull of the fence. As described, connectors 97, which may slide, are connected vertically above connectors 95 which are connected to prevent sliding, and therefore all connectors are held against sliding upon tightening of the wires. Once tightened by the wires, all connectors are secured against the posts, lugs, and adjacent connectors.

The connectors of the invention may take various configurations to connect posts in various orientations. The connectors described for FIGS. 4–8 connect two posts at ninety degree angles, and correspond to connectors 63 and 67 in FIG. 3 and connectors 95 and 97 in FIGS. 9 and 10.

FIGS. 11–13 show a connector corresponding to connector 64 in FIG. 3, which connects three posts at ninety degree angles. Such connector has a securement section 110 similar to that of the securement section 74 of the connector of FIGS. 4–8 with arms 111 extending from receiving section 115. Each arm 111 has an opening 113 toward the free ends thereof. Securement of the connector to a T-post is as previously described with a closure member 114. The illustrated connector has a receiving section 115 with opening 117 and a receiving section 116 with opening 118 for freely receiving T-posts therein. The receiving sections 115 and 116 are positioned at ninety degrees to one another so connect T-posts at ninety degrees. Thus, with the connector connected to a T-post 120, FIGS. 12 and 13, a T-post 121 can be received in receiving section 115 and a T-post 122 can be received in receiving section 116, at ninety degrees to T-post 121. Both are at ninety degrees to vertical post 120. This is a configuration of posts satisfactory for a fence corner as shown in FIG. 3.

FIGS. 14–18 show a connector corresponding to connectors 50 in FIG. 1, which connects posts at an angle. Such connector has a securement section 125 with arms 126 extending from receiving section 131. Each arm 126 has an opening 128 toward the free end thereof. Securement of the connector to a T-post 129 is as previously described with a closure member 130, FIGS. 17 and 18. The illustrated connector has a receiving section 131 with opening 132 for freely receiving a T-post 133 therein. Receiving section 131 has a long wall 134, FIGS. 15–18, and short wall 135, FIGS. 16–18, to hold the connector at an angle to the T-post 129 to which it is connected. The connector can be configured, depending upon the relative lengths of long wall 134 and short wall 135, to position the receiving section at any desired angle. Usually angles of forty five or sixty degrees will be used. Again, as shown by FIGS. 18*a*–18*c*, the arms 126 and end of the receiving portion 131 from which arms 126 extend, as well as closure member 130, all are sized to fit between lugs 136 to limiting sliding of the connector along the post in various orientations of the connector with respect to the post.

FIGS. 19–21 show a connector corresponding to gate connectors 56 in FIG. 3 (also shown but not numbered in FIG. 9), which connect a gate to a fence post. Such connector has a securement section 140 with arms 141 extending from receiving section 145. Each arm 141 has an opening 143 toward the free end thereof. Securement of the connector to a T-post 144 is as previously described with a closure member not shown. The receiving section 145 has a hinge pin 146 secured thereto and extending therefrom. A gate hinge 147 is placed onto the hinge pin 146 as shown in FIG. 21 so as to be able to rotate thereon so that the gate can be swung open or closed. The connector is prevented from sliding along the fence post 144 by sliding by gravity against a lug 148, FIG. 21.

FIGS. 22–25 show a connector for securement to a wooden fence post 150 rather than a T-post. Such connector has a securement section 151 with arms 152 extending from receiving section 156. Each arm 152 has one or more openings 154 toward the free end thereof. To secure the connector to the wooden post 150, a securement means 155, such as a screw or nail, is placed through an opening 154 into the fence post. A receiving section 156 has an opening 157 to receive a T-post 158 therein. When using a wood fence post and a T-post as a stabilizing post, the T-post, generally made of steel, if it directly abuts the wood post, can dig into the wood post over time, loosening the stabilizing section. It is therefore preferred to provide a divider between the securement section 151 and receiving section 156 to separate the T-post in the receiving section from the wood post to which the connector is secured. This may be done by using arm 152*a*, FIG. 24, as a divider by forming it to extend at least partially across the opening of the tubular receiving section 156 where it joins the securement section 151. This arm is difficult to get to when receiving section 156 is angled, as shown, and is not needed for securement since the remaining arms are sufficient to secure the post connector to the post 150. In fact, the connector will generally work satisfactorily with a single arm, particularly if two or more openings 154 are provided in the arm. The receiving section 156 may be arranged with respect to arms 152 to provide any desired angular orientation of the receiving section. Thus, while the receiving section 156 is shown angled with respect to post 150, it could form a ninety degree angle or any other desired angle.

The connectors of the invention may be made of various materials, such as metal or plastic. The connectors may also be formed or fabricated in various ways. When made of metal, they can be easily fabricated from a metal tube, preferably a square tube, by cutting the tube at one end to separate it into arms, while the other end of the tube becomes the receiving section. An extruded metal tube works well. However, they may also be made from flat stock bent to the desired configuration, may be cast to the desired configuration, or made up of a plurality of parts joined together, such as by welding or other assembly techniques. If made of plastic, the connectors will generally be molded into the desired configuration, although an extruded or molded plastic tube can be cut, as with a metal tube, to form the connector.

Whereas the invention is here illustrated and described with reference to embodiments thereof presently contemplated as the best mode of carrying out the invention in actual practice, it is to be understood that various changes may be made in adapting the invention to other embodiments without departing from the inventive concepts disclosed herein and comprehended by the claims that follow.

I claim:

1. A fence post connector for attachment to a T-post type fence post for connecting an item to the T-post type fence post, wherein the T-post has lugs extending periodically therefrom along one side thereof, comprising:

a pair of spaced securement arms each having a free end, the pair of arms being spaced to receive the T-post to which the post connector is to be secured between the spaced arms;

a closure member which extends between the arms, the arms and the closure member each being configured and sized to fit between lugs extending from the T-post, such that with a T-post positioned between the arms, an arm or the closure member can fit between lugs and will abut a lug to limit sliding of the post connector along the fence post; and at least one receiving means configured to receive the item to be connected to the fence post.

2. A fence post connector according to claim 1, wherein each of the arms has an opening therethrough toward the free end thereof, and wherein the closure member extends between the arms and through the openings.

3. A fence post connector according to claim 2, wherein the closure member is a belt.

4. A fence post connector according to claim 1, wherein the item to be connected to the fence post is another fence post, and wherein the receiving means includes an opening into which the end of the fence post to be connected is inserted.

5. A fence post connector according to claim 4, wherein the receiving means forms a receiving tube for freely receiving the end of the fence post to be connected.

6. A fence post connector according to claim 5, wherein the receiving means forms a square receiving tube.

7. A fence post connector according to claim 1, wherein the item to be connected to the fence post is a gate hinge, and wherein the receiving means includes a hinge pin to receive a gate hinge thereon.

8. A fence post connector according to claim 1, wherein the at least one receiving means is two receiving means.

9. A fence post connector according to claim 8, wherein the two receiving means are arranged at substantially right angles to one another in a plane substantially perpendicular to the post to which the connector is to be secured.

10. A fence post connector according to claim 1, wherein the receiving means is arranged to be in a plane substantially perpendicular to the post to which the connector is to be secured.

11. A fence post connector according to claim 1, wherein the receiving means is arranged to be in a plane which intersects the post to which the connector is to be secured at an angle.

12. A fence post connector according to claim 5, wherein the receiving means is open to the securement arm so that a fence post end received in the receiving means will, when the fence post connector is attached to fence post, extend through the receiving means and abut the fence post to which the connector is attached.

13. A fence post connector for joining fence posts to form a stabilizing section offence, wherein the post connector is to be secured to a fence post in such stabilizing section which has a series of lugs extending from one surface of the fence post at substantially regular intervals, comprising:

a securement section including a pair of spaced arms each having a free end and spaced to receive the fence post to which the post connector is to be secured between the spaced arms, said arms adapted to have a closure member removably attached between the free ends of the arms when the fence post is positioned between the arms to capture the fence post therein with at least one of the closure member and respective arms being sized to fit between adjacent lugs to secure, at least loosely, the post connector in a desired position along the fence post; and at least one receiving section configured to freely receive therein an end of a fence post to be received therein.

14. A stabilizing section offence comprising two spaced apart fence posts extending substantially vertically from the surface into which the fence is installed; a fence post connector of claim 1 secured to each of the two spaced apart fence posts; a third fence post serving as a stabilizing fence post extending between the post connectors with ends freely received in respective post connectors; and wire extending and tightened between two of the fence posts to securely hold the ends of the stabilizing fence post in the respective post connectors to thereby stabilize the section of fence.

15. A stabilizing section offence according to claim 14, wherein the stabilizing fence post extends diagonally between the two spaced apart fence posts.

16. A stabilizing section offence according to claim 15, wherein the wire extends between an intermediate position along the stabilizing fence post to one of the two spaced apart fence posts.

17. A stabilizing section offence according to claim 14, wherein the stabilizing fence post extends substantially horizontally between the two spaced apart fence posts.

18. A stabilizing section offence according to claim 17, wherein the wire extends between the two spaced apart fence posts.

19. A fence post connector for attachment to a T-post type fence post for connecting a second fence post to the T-post type fence post, wherein the T-post type fence post has lugs extending periodically therefrom along one side thereof; comprising:

a pair of spaced, substantially straight securement arms each having a free end, the pair of arms being spaced to receive the T-post type fence post to which the post connector is to be secured between the substantially straight spaced arms;

a closure member which extends between the arms, the arms and the closure member each being configured and sized to fit between lugs extending from the T-post type fence post, such that with a T-post type fence post positioned between the arms, an arm or the closure member can fit between lugs and will abut a lug to limit sliding of the post connector along the T-post type fence post; and at least one tubular receiving means including an opening therein configured to freely receive an end of the second fence post inserted thereinto wherein the receiving means is open to the at least one securement arm so that the end of the second fence post received in the receiving means will, when the fence post connector is attached to a fence post, extend through the receiving means and abut the fence post to which the connector is attached.

20. A fence post connector according to claim 19, wherein each of the arms has an opening therethrough toward the free end thereof; and wherein the closure member extends between the arms and through the openings.

21. A fence post connector according to claim 20, wherein the closure member is a bolt.

* * * * *

UNITED STATES PATENT AND TRADEMARK OFFICE

CERTIFICATE OF CORRECTION

PATENT NO. : 6,705,598 B2
DATED : March 16, 2004
INVENTOR(S) : Charles R. Collins It is certified that error appears in the above-identified patent and that said Letters Patent is hereby corrected as shown below:

Column 11,
Line 2, “belt” should be -- bolt --.
Lines 38 and 55, “offence” should be -- of fence --.

Column 12,
Lines 9, 12, 16 and 19, “offence” should be -- of fence --.

Column 14,
Line 55, “offence” should be -- of fence --.

Signed and Sealed this

Fourteenth Day of September, 2004

JON W. DUDAS
*Director of the United States Patent and Trademark Office*